US007724118B1

(12) United States Patent
Chen

(10) Patent No.: US 7,724,118 B1
(45) Date of Patent: May 25, 2010

(54) PULSE TRANSFORMER WITH A CHOKE PART

(75) Inventor: Aaron Chen, Cishan Township (TW)

(73) Assignee: Taimag Corporation, Kaohsiung (TW)

( * ) Notice: Subject to any disclaimer, the term of this patent is extended or adjusted under 35 U.S.C. 154(b) by 0 days.

(21) Appl. No.: 12/329,340

(22) Filed: Dec. 5, 2008

(51) Int. Cl.
*H01F 27/24* (2006.01)

(52) U.S. Cl. ..... 336/229; 336/220

(58) Field of Classification Search ..... 336/229, 336/212, 220
See application file for complete search history.

(56) References Cited

U.S. PATENT DOCUMENTS 3,781,740 A * 12/1973 Kirmis et al. ..... 336/96
6,457,464 B1 * 10/2002 Rapoport et al. ..... 123/605
2002/0121955 A1 * 9/2002 Yeh et al. ..... 336/198
2004/0140880 A1 * 7/2004 Haugs et al. ..... 336/229
2005/0253678 A1 * 11/2005 Nishino et al. ..... 336/229

* cited by examiner

*Primary Examiner*—Anh T Mai
(74) *Attorney, Agent, or Firm*—Black Lowe & Graham, PLLC

(57) ABSTRACT

A pulse transformer includes a core unit and a coil unit. The core unit includes an annular core part, and an annular choke part that is disposed in contact with the annular core part. The coil unit includes a plurality of coils, each of which is wound around both of the annular core part and the annular choke part.

6 Claims, 6 Drawing Sheets

PULSE TRANSFORMER WITH A CHOKE PART

BACKGROUND OF THE INVENTION

1. Field of the Invention

The invention relates to a pulse transformer, more particularly to a pulse transformer with a choke part.

2. Description of the Related Art

As shown in FIG. 1, a conventional pulse transformer is for use in the field of digital communication. The conventional pulse transformer includes an annular core 11 that is made from a ferromagnetic material, an annular choke 12 that is also made from a ferromagnetic material, and four coils 13 wound around the annular core 11 and the annular choke 12 in a manner illustrated in FIG. 1. Show in FIG. 2 is an equivalent circuit diagram for the conventional pulse transformer.

The conventional pulse transformer is manufactured by first winding the four coils 13 on the annular core 11, followed by winding two of the four coils 13 on the annular choke 12.

For pulse transformers for use in the field of digital communication, due to the small size of the annular core 11, to wind the coils, which are usually in the form of enamel-covered wires, on the relatively small annular core 11 and annular choke 12, and to place the coil-wound annular core 11 and the coil-wound annular choke 12 into a housing (not shown) for subsequent packaging are steps that still require manual labor.

Since the conventional pulse transformer requires two manual coil winding steps (respectively for the annular core 11 and the annular choke 12), the fabrication of the conventional pulse transformer is time consuming and costly, thereby resulting in a low productivity.

SUMMARY OF THE INVENTION

Therefore, the object of the present invention is to provide a pulse transformer that only requires one coil-winding step.

According to the present invention, there is provided a pulse transformer that includes a core unit and a coil unit.

The core unit includes an annular core part, and an annular choke part that is disposed in contact with the annular core part.

The coil unit includes a plurality of coils, each of which is wound around both of the annular core part and the annular choke part.

The advantage of the present invention resides in that since the annular core part and the annular choke part are combined into one composite core unit before the coils are wound therearound, the pulse transformer of the present invention only requires one manual coil winding step, thereby simplifying the fabrication process for the pulse transformer of the present invention.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
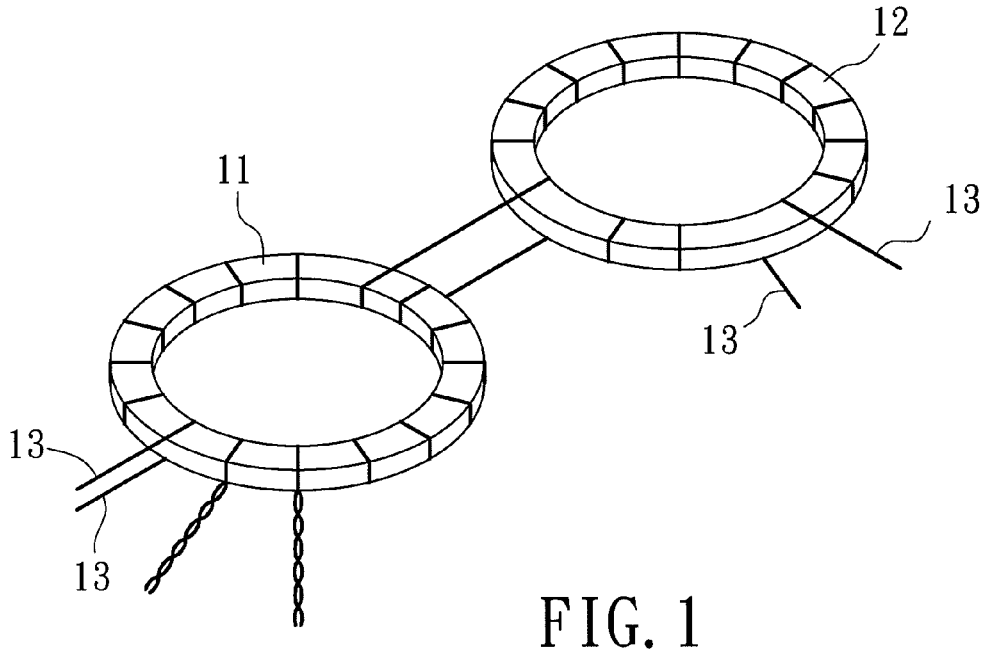
FIG. 1 PRIOR ART
FIG. 1 is a schematic perspective view of a conventional pulse transformer.
Figure 2:
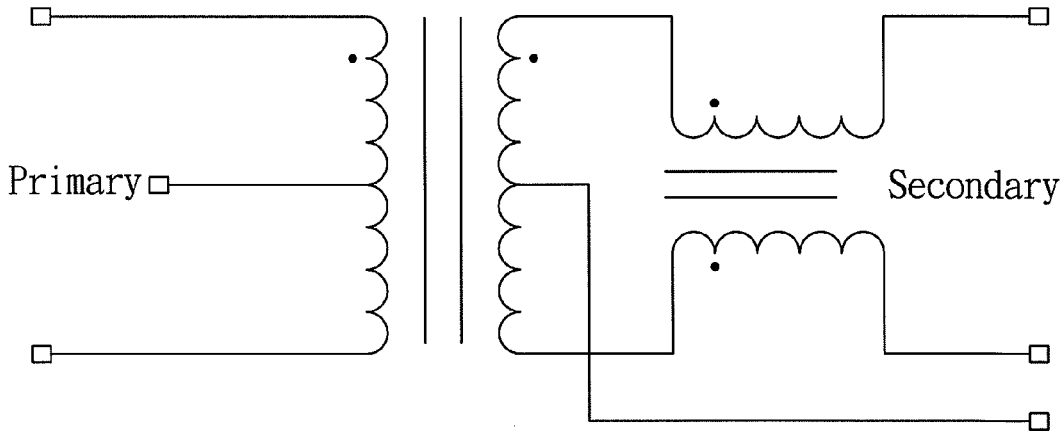
FIG. 2 PRIOR ART
FIG. 2 is an equivalent circuit diagram for the conventional pulse transformer shown in FIG. 1.

Before the present invention is described in greater detail, it should be noted that like elements are denoted by the same reference numerals throughout the disclosure.

Figure 3:
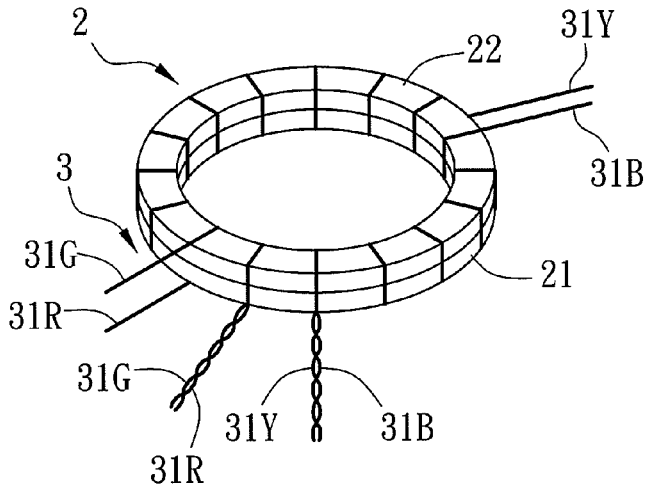
FIG. 3 is a schematic perspective view of the first preferred embodiment of a pulse transformer according to the present invention.

Referring to FIG. 3, the first preferred embodiment of a pulse transformer according to the present invention includes a core unit 2 and a coil unit 3.

The core unit 2 includes an annular core part 21, and an annular choke part 22 that is disposed in contact with the annular core part 21. The annular core part and the annular choke part 22 are made from a ferromagnetic material. In this embodiment, the annular core part 21 and the annular choke part 22 have substantially identical shapes, are stacked concentrically, and are respectively made from manganese and nickel.

The coil unit 3 includes a plurality of coils 31G, 31R, 31Y, 31B, which are hereinafter respectively referred to as a green coil 31G, a red coil 31R, a yellow coil 31Y, and a blue coil 31B. Each of the green, red, yellow, and blue coils 31G, 31R, 31Y, 31B is wound around both of the annular core part 21 and the annular choke part 22, such that six distinct terminals are formed in the pulse transformer. The six terminals are respectively formed by the green coil 31G, the red coil 31R, the yellow coil 31Y, the blue coil 31B, the green and red coils 31G, 31R twisted together, and the yellow and blue coils 31Y, 31B twisted together. The terminals formed by the green coil 31G, the red coil 31R, and the twisted green and red coils 31G, 31R cooperate to constitute a primary side of the pulse transformer, where the terminal formed by the twisted green and red coils 31G, 31R form a center tap. On the other hand, the terminals formed by the yellow coil 31Y, the blue coil 31B, and the twisted yellow and blue coils 31Y, 31B cooperate to constitute a secondary side of the pulse transformer, where the twisted yellow and blue coils 31Y, 31B form a center tap.

It should be noted herein that the number of windings for each of the green, red, yellow, and blue coils 31G, 31R, 31Y, 31B, and the choice of material for the annular core part 21 and the annular choke part 22 depend on the specification set forth for the particular product to be made. Since these should be readily appreciated by those skilled in the art, details of the same are omitted herein for the sake of brevity.

Figure 4:
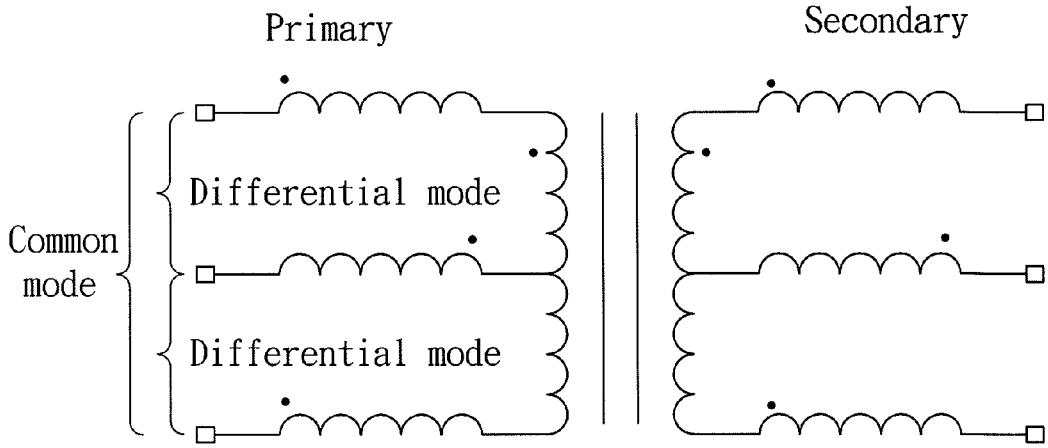
FIG. 4 is an equivalent circuit diagram for the first preferred embodiment.

Shown in FIG. 4 is an equivalent circuit diagram for the first preferred embodiment. Not only does the first preferred embodiment achieve operation in a common mode as with the prior art, the first preferred embodiment can also operate in a differential mode.

It should be noted herein that the coil unit 3 of this embodiment includes four coils 31G, 31R, 31Y, 31B in order to form the center taps on each of the primary and secondary sides. However, for other embodiments where center taps are not required, the coil unit can include only two coils, and for those embodiments where only one center tap is required for one of the primary and secondary sides, the coil unit can include only three coils. In other words, the number of coils included in the coil unit is application dependent, and should not be considered a limitation to the scope of the present invention.

It should be further noted herein that the annular core part 21 and the annular choke part 22 can be made such that magnetic flux direction of the annular choke part 22 is opposite to that of the annular core part 21. As a result, when the annular core part 21 and the annular choke part 22 are combined together concentrically, the magnetic fluxes in the annular core part 21 and the annular choke part 22 cancel out each other so that electromagnetic interference generated thereby is reduced, and overall inductance value of the pulse transformer is stabilized.

Figure 5:
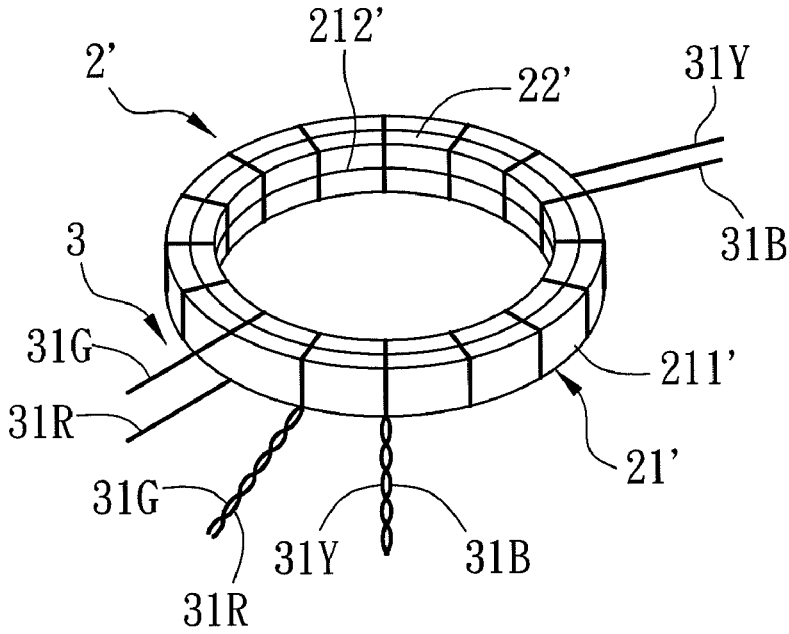
FIG. 5 is a schematic perspective view of the second preferred embodiment of a pulse transformer according to the present invention.
Figure 6:
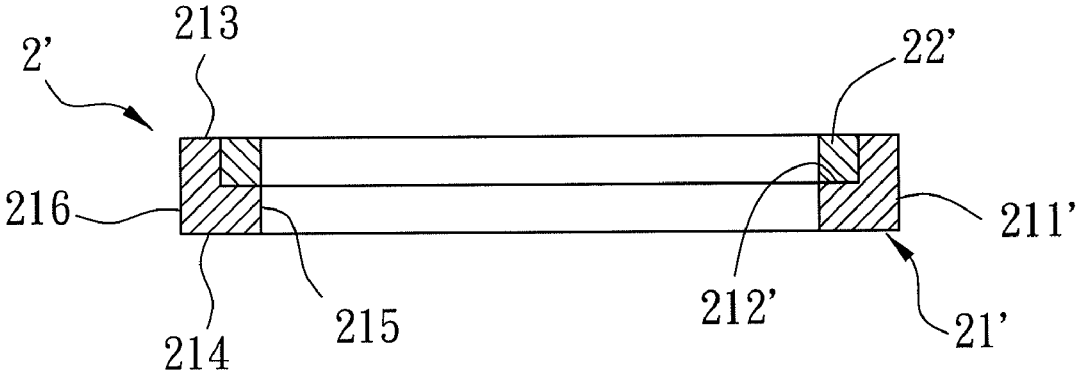
FIG. 6 is a sectional view of a core unit of the second preferred embodiment.

With reference to FIG. 5 and FIG. 6, the second preferred embodiment of a pulse transformer according to the present invention differs from the first preferred embodiment in that the annular core part 21' of the core unit 2' of the second preferred embodiment includes an annular core body 211' that is formed with an annular groove 212'. Furthermore, the annular choke part 22' of the second preferred embodiment is disposed in the annular groove 212'.

In particular, the annular core body 211' of the annular core part 21' has first and second surfaces 213, 214 opposite to each other in a transverse direction, and inner and outer annular surfaces 215, 216 connecting the first and second surfaces 213, 214 and opposite to each other in radial directions transverse to the transverse direction. The annular groove 212' is formed in the first surface 213 and the inner annular surface 215 of the annular core part 21'.

Figure 7:
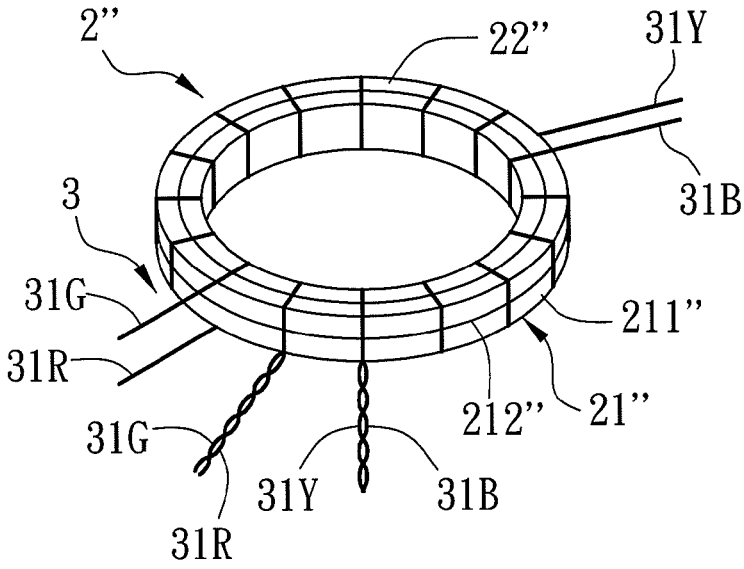
FIG. 7 is a schematic perspective view of the third preferred embodiment of a pulse transformer according to the present invention.
Figure 8:
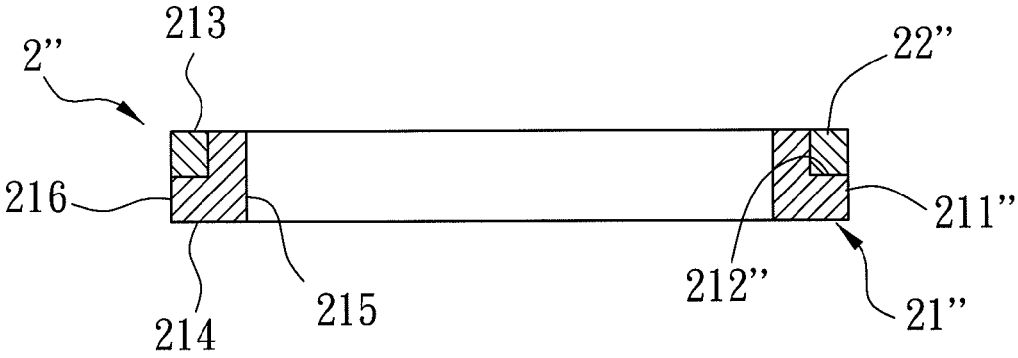
FIG. 8 is a sectional view of a core unit of the third preferred embodiment.

With reference to FIG. 7 and FIG. 8, the third preferred embodiment of a pulse transformer according to the present invention differs from the second preferred embodiment in that the annular groove 212" of the core unit 2" of the third preferred embodiment, within which the annular choke part 22" is disposed, is formed in the first surface 213 and the outer annular surface 216 of the annular core part 21".

Figure 9:
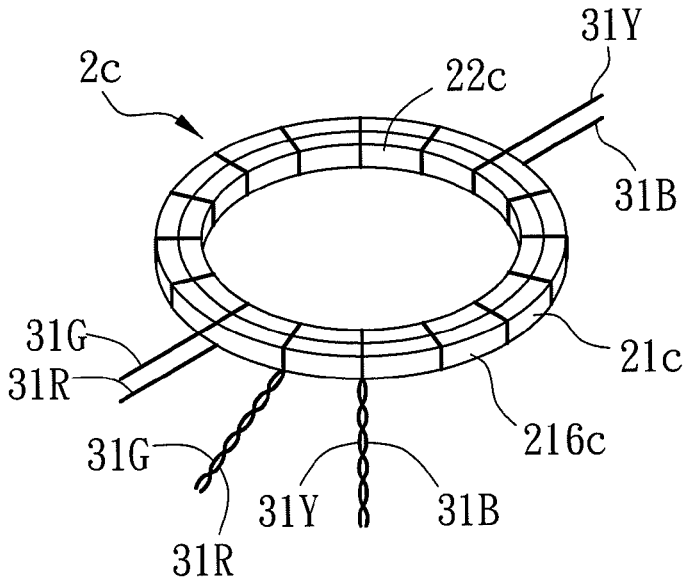
FIG. 9 is a schematic perspective view of the fourth preferred embodiment of a pulse transformer according to the present invention.

With reference to FIG. 9, the fourth preferred embodiment of a pulse transformer according to the present invention differs from the first preferred embodiment in that each of the annular core part 21*c* and the annular choke part 22*c* of the core unit 2*c* of the fourth preferred embodiment has inner and outer annular surfaces. The annular choke part 22*c* is disposed concentrically with the annular core part 21*c* such that the outer annular surface of the annular choke part 22*c* is disposed in contact with the inner annular surface of the annular core part 21*c*. In this case, a thickness of the pulse transformer is reduced as compared to the previous embodiments.

Figure 10:
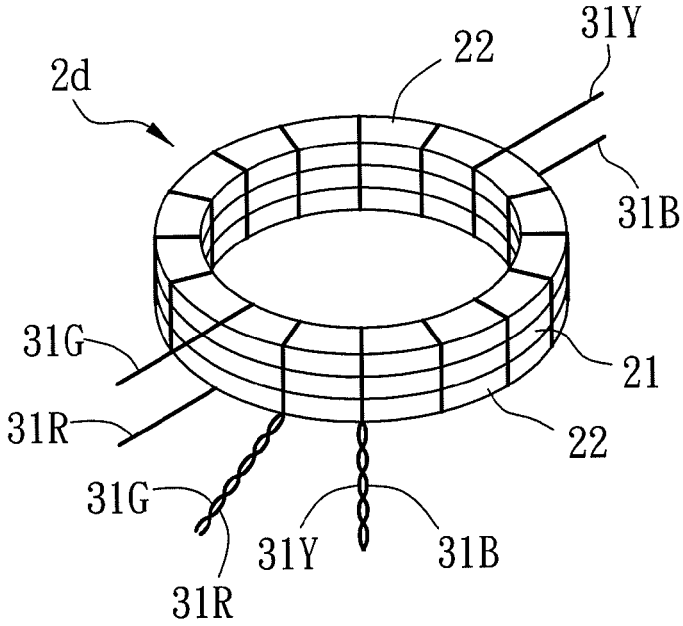
FIG. 10 is a schematic perspective view of the fifth preferred embodiment of a pulse transformer according to the present invention.

With reference to FIG. 10, the fifth preferred embodiment of a pulse transformer according to the present invention differs from the first preferred embodiment in that the core unit 2*d* of the fifth preferred embodiment includes two of the annular choke parts 22. The annular core part 21 and the annular choke parts 22 are stacked concentrically such that the annular core part 21 is interposed between the annular choke parts 22.

From an actual Internet Protocol (IP) transmission test conducted for the preferred embodiments previously disclosed, it was verified that the pulse transformer according to the present invention complies with the standard set forth for transmission distances of over 100 meters, since no packet loss occurred for one hundred thousand packets transmitted over a transmission distance of 200 meters under a transmission rate of 1 Gbps in the IP transmission test.

Figure 11:
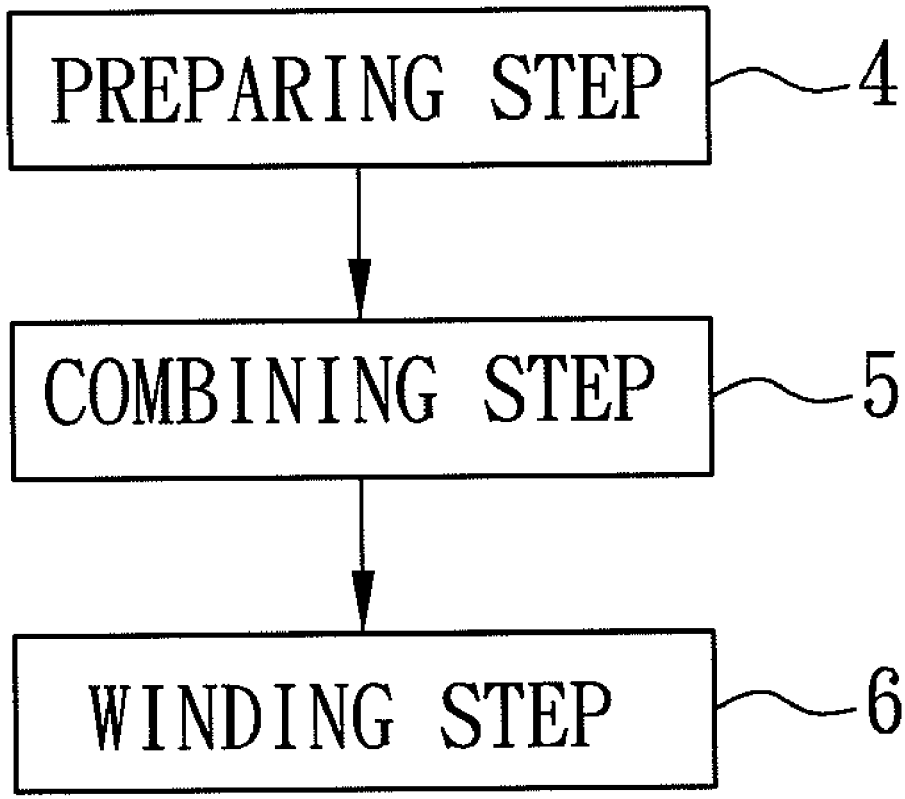
FIG. 11 is a flow chart showing a method for manufacturing a pulse transformer according to the present invention.

FIG. 11 illustrates a method for manufacturing the pulse transformer of the present invention. The first preferred embodiment shown in FIG. 3 is used for illustration purposes. First, the annular core part 21 and the annular choke part 22 are prepared (step 4) by, for example, sintering, which is known in the art. Second, the annular core part 21 and the annular choke part 22 are combined concentrically into one composite core unit (step 5). Optionally, the annular core part 21 and the annular choke part 22 are combined together using an adhesive. Lastly, the plurality of coils 31G, 31R, 31Y, 31B are wound around the composite core unit 2 (step 6).

In summary, the pulse transformer according to the present invention has the following advantages:

1. Simplified Winding Process:

Since the annular core part 21 and the annular choke part 22 are combined into one composite core unit 2 before the coils 31G, 31R, 31Y, 31B are wound therearound, the pulse transformer of the present invention only requires one manual coil winding step, as compared to two manual coil winding steps in the prior art, thereby simplifying the fabrication of the pulse transformer of the present invention.

2. Differential Operation Mode:

By winding after combining the concentrically disposed annular core part 21 and the annular choke part 22 into a composite unit, the pulse transformer of the present invention can operate under both a differential mode and a common mode, as compared to operation only under the common mode in the prior art, thereby enhancing the applicability of the pulse transformer of the present invention.

3. Low Electromagnetic Interference and Stable Inductance Value:

Since the annular core part 21 and the annular choke part 22 can be made such that magnetic flux direction of the annular choke part 22 is opposite to that of the annular core part 21, when the annular core part 21 and the annular choke part 22 are combined together concentrically, the magnetic fluxes in the annular core part 21 and the annular choke part 22 cancel out each other so that electromagnetic interference generated thereby is reduced, and overall inductance value of the pulse transformer is stabilized.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A pulse transformer comprising:

a core unit including an annular core part, and an annular choke part that is disposed in contact with said annular core part; and a coil unit including a plurality of coils, each of which is wound around both of said annular core part and said annular choke part;

wherein said annular core part includes an annular core body that is formed with an annular groove, said annular choke part being disposed in said annular groove.

2. The pulse transformer as claimed in claim 1, wherein said annular core part and said annular choke part are stacked concentrically.

3. The pulse transformer as claimed in claim 1, wherein said annular core body of said annular core part has first and second surfaces opposite to each other in a transverse direction, and inner and outer annular surfaces connecting said first and second surfaces and opposite to each other in radial directions transverse to the transverse direction, said annular groove being formed in said first surface and said inner annular surface.

4. The pulse transformer as claimed in claim 1, wherein said annular core body of said annular core part has first and second surfaces opposite to each other in a transverse direction, and inner and outer annular surfaces connecting said first and second surfaces and opposite to each other in radial directions transverse to the transverse direction, said annular groove being formed in said first surface and said outer annular surface.

5. The pulse transformer as claimed in claim 1, wherein each of said annular core part and said annular choke part has inner and outer annular surfaces, said annular choke part being disposed concentrically with said annular core part such that said outer annular surface of said annular choke part is disposed in contact with said inner annular surface of said annular core part.

6. The pulse transformer as claimed in claim 1, wherein said core unit includes two of said annular choke parts, said annular core part and said annular choke parts being stacked concentrically such that said annular core part is interposed between said annular choke parts.

* * * * *